US011141738B2

(12) United States Patent
Venturi

(10) Patent No.: US 11,141,738 B2
(45) Date of Patent: Oct. 12, 2021

(54) CRUSHER FOR RUBBLE

(71) Applicant: CAMS S.R.L., Castel San Pietro Terme (IT)

(72) Inventor: Marco Venturi, Bologna (IT)

( * ) Notice: Subject to any disclaimer, the term of this patent is extended or adjusted under 35 U.S.C. 154(b) by 233 days.

(21) Appl. No.: 15/779,507

(22) PCT Filed: Oct. 27, 2016

(86) PCT No.: PCT/IB2016/056453
§ 371 (c)(1),
(2) Date: May 25, 2018

(87) PCT Pub. No.: WO2017/109597
PCT Pub. Date: Jun. 29, 2017

(65) Prior Publication Data

US 2018/0345293 A1 Dec. 6, 2018

(30) Foreign Application Priority Data

Dec. 23, 2015 (IT) ..... 102015000087105

(51) Int. Cl.
*B02C 18/00* (2006.01)
*B02C 18/22* (2006.01)
*B02C 18/14* (2006.01)

(52) U.S. Cl.
CPC ..... *B02C 18/2233* (2013.01); *B02C 18/142* (2013.01)

(58) Field of Classification Search
CPC ... B02C 18/142; B02C 18/2233; B02C 18/22; B02C 18/2225; B02C 18/2275; B02C 13/286; B02C 2013/28618; B02C 2013/28687
USPC ..... 241/236, 280
See application file for complete search history.

(56) References Cited

U.S. PATENT DOCUMENTS 4,925,116 A * 5/1990 Lundell ..... B02C 18/142 241/167
5,248,100 A * 9/1993 Arakawa ..... B02C 18/142 241/34

FOREIGN PATENT DOCUMENTS

| | | | | |
|---|---|---|---|---|
| CA | 2121539 | A1 * | 10/1994 | ..... B02C 21/02 |
| CN | 202657508 | | 1/2013 | |
| CN | 204182447 | | 3/2015 | |
| DE | 9209945 | U1 * | 11/1992 | ..... B02C 18/2225 |
| DE | 4316314 | A1 * | 11/1994 | ..... B02C 18/145 |
| DE | 10008044 | A1 * | 8/2001 | ..... B02C 18/2233 |
| DE | 10230461 | | 1/2004 | |

(Continued)

OTHER PUBLICATIONS

Translation of Schober DE10008044A1. Translated Apr. 2020 (Year: 2001).*

(Continued)

*Primary Examiner* — Faye Francis
(74) *Attorney, Agent, or Firm* — Themis Law

(57) ABSTRACT

A crusher for rubble includes a crushing chamber in which the nibbles are ground, a grinding group inserted in the crushing chamber to grind the rubble, and a conveying channel of the rubble into the grinding group. The crusher includes two or more pushers, which act in the conveying channel toward the grinding group to push the rubble against the grinding group, and which are controlled separately from each other, so to be place one or more of the pushers at rest separately when one or more of the other ones are actuated.

5 Claims, 2 Drawing Sheets

(56) References Cited

FOREIGN PATENT DOCUMENTS

| | | | | |
|---|---|---|---|---|
| FR | 2927268 A1 * | 8/2009 | ..... | B02C 13/286 |
| JP | 2004305860 | 11/2004 | | |
| WO | 2011092588 | 8/2011 | | |

OTHER PUBLICATIONS

Maier—DE 9209945—Translated Aug. 3, 2020 (Year: 1992).*
Translation: Thierry—FR-2927268-A1—Translated Jan. 14, 2021 (Year: 2009).*
Pallman—DE 4316314 A1—Translated Aug. 3, 2020 (Year: 1994).*

* cited by examiner

CRUSHER FOR RUBBLE

FIELD OF INVENTION

The present invention is generally applicable to the technical construction and services fields, and it particularly refers to the treatment of residues of construction elements such as debris resulting from demolition of buildings or from the removal or rebuilding of roads or other similar works.

More in detail, the present invention relates to a crusher for rubble.

BACKGROUND OF THE INVENTION

By demolishment, even partial, of buildings for reconstruction, or due to destructive events, as well as the rebuilding of roads or other several works of man, large size debris is typically generated. These should be obviously disposed, and often their size, combined with the weight that consequently they have, make its disposal difficult, if not daunting.

Different types of rubble crushers are known in the art. Among them, one of the most effective is constituted by machines that have a casing, inside which the cutters are positioned, which grip the rubble and shred it, reducing it into small size elements.

Usually crushers are equipped with a loading hopper arranged above the cutters, where the bulldozers, cranes or similar can upload the rubble to be shredded.

Regarding the cutters, they are generally constituted by rotary units made by assembling a plurality of mutually coaxial discs fitted on the periphery with the crushing teeth. The discs are typically interspersed with spacers so that two rotors can be placed frontally to each other and partially interpenetrate, arranging the discs of one rotor in correspondence with the spacers of the other rotor.

The two rotors are made to rotate in opposite directions to each other, so that with such rotation the teeth in the periphery of the discs of a rotor can cooperate with the teeth in the periphery of the discs of the other rotor, grasping the rubble between them and compressing it until it breaks.

Since the rubble from the hopper is directed towards the interpenetration zone between the rotors, and then it must come out downward near the same interpenetration zone, it is evident that the grasping and fragmentation process of the rubble continues until the size of the fragments becomes small enough to pass through the detectable spaces between the two rotors.

Sometimes the size of the rubble is of such dimensions that it forms a sort of capon the rotors. To that effect other crushers are well known such as the ones described in patent documents CN 202657508 U and CN 204182447 U, which disclose pushers that act on the rubble to remove the aforementioned cap. In other words, the pushers alternately hit the rubble to ensure that they continue their downward process towards the cutters.

However, the rubble may still include some substantially plate-like elements that become disposed parallel to the shredding zone, and that the teeth of the crusher are not able to crush. Those elements usually are particularly difficult to crush, because those elements bounce on the teeth and, in fact, "float" over the shredding zone without being scratched.

This constitutes a problem since it forces the operators to intervene by interrupting the production by stopping the system in order to extract these parts from the supplying hopper, and ensuring other means to break up the artifacts. This operation, other than being dangerous, slows down the rubble disposal process. In addition, it may happen that some particular plate-like elements, which individually would have dimensions compatible with the grasping capacity of the crusher, when they arrive in the hopper in a high quantity, interact with each other and "float" over the shredding zone.

SUMMARY OF THE INVENTION

An object of the present invention is to at least partially overcome the above-mentioned drawbacks, by providing a crusher of rubble that ensures its shredding without the need of an intervention by operators, particularly in cases where "floating" rubble is above the grinding group.

Another object is that the crusher of the invention can provide for the complete shredding of the rubble without operator intervention, even in case of plate-like and particularly resistant elements.

A further object of the invention is that this crusher of rubble generates shredding rates as high as possible.

Another object is that the crusher of rubble can have levels of execution complexity and associated costs at most equivalent, if not inferior, to the equivalent already known crushers.

Such objects, and others that will appear more clearly hereinafter, are fulfilled by a crusher of rubble according to the following claims, which are to be considered an integral part of the present application.

In particular, the crusher comprises a crushing chamber in which the rubble is crushed, and further comprises at least one crushing group inserted in the same chamber for crushing the rubble. It also comprises at least one conveying channel of the rubble towards the crushing group and usually, but not necessarily, a loading hopper.

According to an aspect of the invention, the crusher includes also two or more pushers acting in the conveying channel towards the crushing group, in order to push the rubble against the crushing group.

In other words, the pushers act on the rubble by pressing it against the crushing group so that it is completely crushed t.

Advantageously, therefore, any possible "floating" elements on the crushing group will be pushed in the crushing zone, obtaining the complete crushing of the rubble without the need of an operator's intervention.

In the present invention, the pushers actively cooperate to crush the rubble accelerating the process.

According to another aspect of the invention, at least one of the pushers is separately and independently controlled with respect to the others, so that it can be placed in the rest position for a while when one or more of the other ones are acting in the conveying channel.

In other words, the pushers do not act necessarily all together at the same time, but one or more of them can be actuated independently from the others.

This allows, advantageously, to increase considerably the crushing process rate. In fact, if the pushers would act in thrust all at once, it would be necessary to wait until the end of the previous crushing process until another load of rubble could be made. In the invention, however, while one or more pusher are in action, one or more of the other ones can be placed to the rest position so that in their working space can be loaded with additional rubble to be crushed. Consequently, with the crusher of the invention, the crushing process can be continuous without having to stop it to proceed with further loads of rubble.

BRIEF DESCRIPTION OF THE DRAWINGS

Further features and advantages of the invention will appear more evident by reading the detailed description of a preferred, but not exclusive, embodiment of a crusher of rubble according to the invention, shown as non-limitative example with the help of the annexed drawings, wherein.

DETAILED DESCRIPTION OF AN EXAMPLE OF A PREFERRED EMBODIMENT

Figure 1:
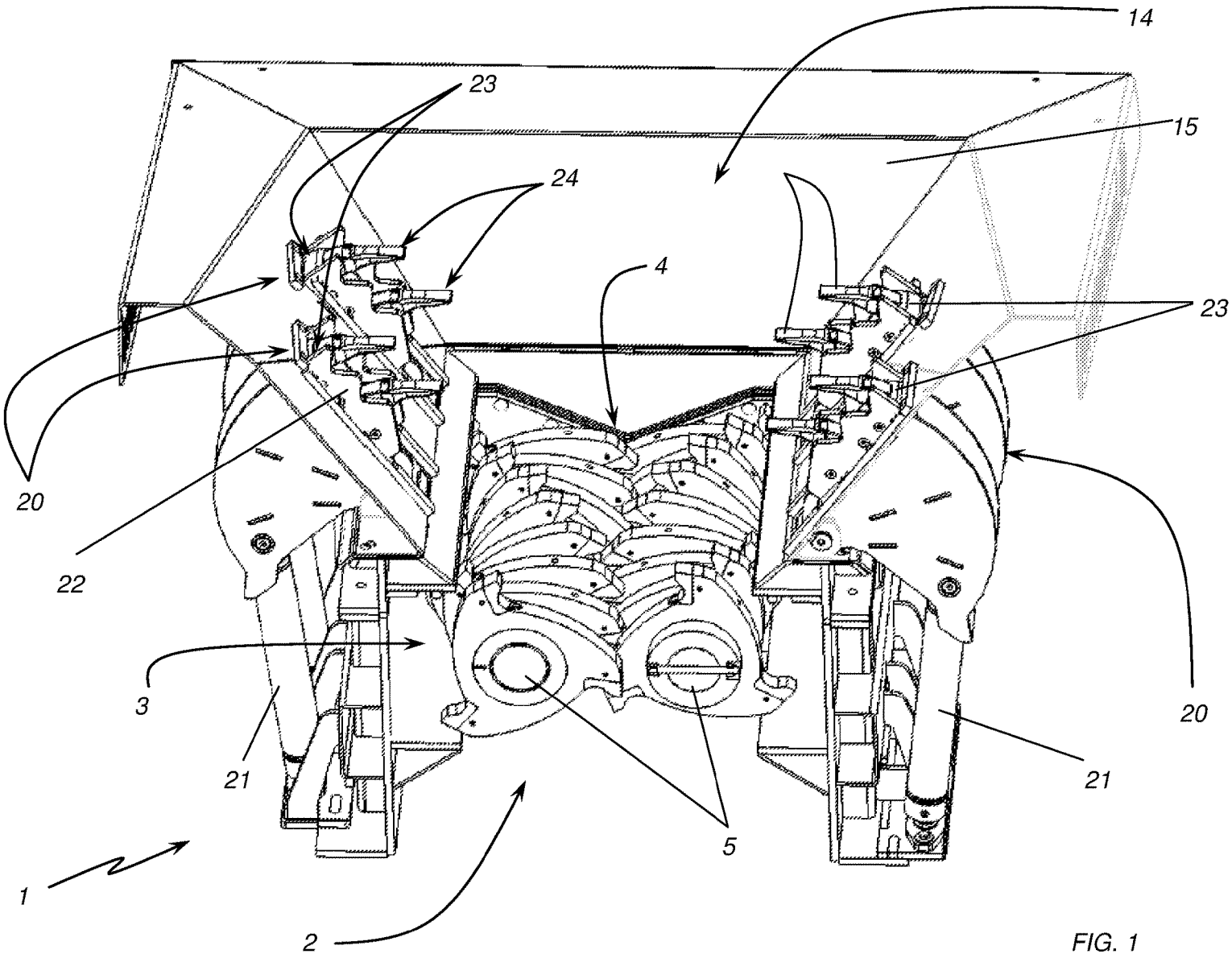
FIG. 1 shows a crusher for rubble according to the invention in a partially sectioned perspective view.

With reference to the above figures, and particularly to FIG. 1, there is described a crusher for rubble 1. Crusher 1 is commonly used for crushing rubble resulting from the dismantling of walls, roads or similar works.

To that effect, crusher 1 includes a crushing chamber 2 in which the rubble is crushed. For this purpose, in the crushing chamber 2 there is a crushing group 3.

Figure 2:
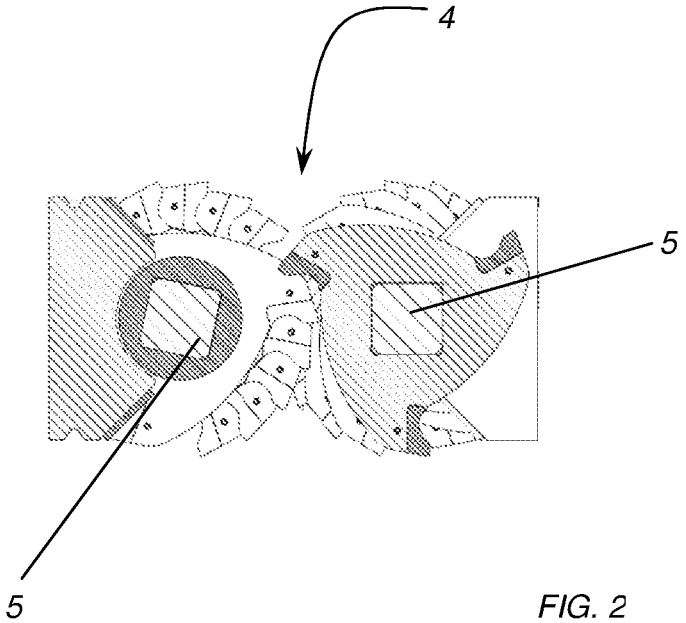
FIGS. 2 and 3 show some details of the crusher for rubble according to FIG. 1.

In the described embodiment, crushing group 3 is composed, as observed also in FIG. 2, by a pair of cutters 5 placed frontally from each other, which at least partially interpenetrate. Among them, a crushing zone 4 for rubble can be identified.

Figure 3:
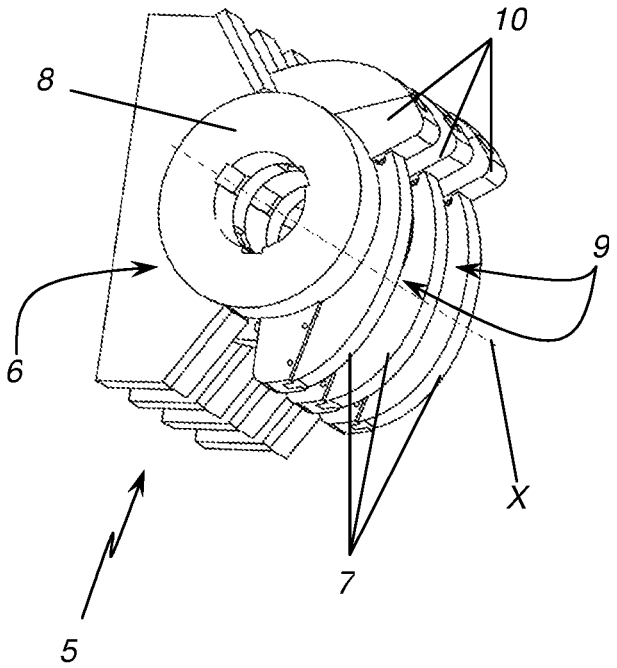

According to an aspect of the invention, each cutter 5 includes, as observed in FIG. 3, a rotor 6 with a plurality of grinder discs 7. These are arranged coaxially to the rotation axis X of the rotor 6. In addition, they are interspersed with spacers 8. In other words, between each adjacent pair of grinder discs 7 of each cutter 5, there is a gap 9 in correspondence of a spacer. In this manner, it is possible to partially penetrate the two cutters 5 disposed frontally to each other by matching a grinder disc 7 of a cutter 5 to a spacer 8 of the other.

On the circumference of the grinder discs 7 crushing teeth 10 are placed, which have cutting edges in order to facilitate the crushing of the rubble.

Obviously, the number of cutters as well as the described embodiment of the crushing group or of the cutters are to be considered examples of embodiments of the invention, and are not limiting for different embodiments.

Also, the number of crushing chambers and crushing groups are not limitative characteristics for the invention.

According to an aspect of the invention, the crusher 1 also includes a conveying channel 14 which, in the embodiment that is presently described, is constituted by a loading hopper 15 to accommodate the rubble and route it into the crushing chamber 2 in the direction of the crushing group 3. It can be seen that the crusher 1 has a vertical operating conformation, so that the rubble is inserted superiorly to the hopper 15, from which it glides towards the crushing group 3. Even this detail is not to be considered limitative for different embodiments of the invention, where the hopper is absent or where the operative configuration of the crusher is inclined or even horizontal, or where following the hopper there is a further element of the conveying channel having another shaping.

In the operational phase, the two cutters 5 are made to rotate in opposite directions, so that the crushing teeth 10 of both cutters cooperate to better grasp the rubble between them, as between two jaws that tighten the rubble until its rupture. The shaping edges of the crushing teeth 10 actively cooperate to crush and grind the rubble.

Where plate-like and/or particularly tenacious elements are present in the rubble, they may not fit in the crushing zone 4, but "float" over it. This, as previously mentioned, would compel operators to intervene.

In order to avoid such drawback, the crusher 1 of the invention comprises two or more pushers 20 acting in the conveying channel 14 towards the crushing group 3 to push the rubble against it.

Particularly, the pushers 20 act on the rubble, pressing it against the crushing group 3 so that it become totally crushed, so avoiding, advantageously, the "floating" of rubble.

It is observed, moreover, that the same pushers 20, with the thrust exerted towards the crushing group 3, cooperate directly to the crushing of the rubble, and also, owing to the lifting action carried out against any eventual plate-like elements, provide for a much easier conveying of these elements towards the center of the crushing chamber 2, so as to overcome the abovementioned risk of "floating".

According to another aspect of the invention, each pusher 20 is separately and independently controlled from the other ones. This allows, advantageously, operating some pushers 20 as desired while the other ones are put in rest position for a while. Consequently, with the same pushers 20, a combined crushing action can be generated also in a parallel direction to the crushing zone 4, facilitating the oblique arrangement of the rubble elements.

Still advantageously, the crushing process is greatly accelerated. In fact, if the pushers 20 acted in thrust all at once, one would have to wait until the total crushing of the previously loaded rubble before proceeding with a further loading. In the invention, however, as long as one or more pushers 20 are in action, one or more of the other ones can be placed in rest position for the time necessary to load additional rubbles. Consequently, with the crusher 1 of the invention, the crushing process can be continuous without having to stop it to proceed with the load of additional rubble.

It is evident that the number of pushers, as well as the fact that they are all separately controlled, are not limitative characteristics for the invention. What is important is that the pushers are at least two, and that there is at least one, or at least one subset, of pushers separately controlled from the other ones.

According to a further aspect of the invention, each pusher 20 comprises an actuator 21 that works on a pusher head 22 which, in its turn, is shaped to push the rubble against the crushing group 3.

It is evident that also the embodiment of the pushers just described must not be considered limitative for the invention. Not only can the number of actuators and plates in the pushers be variable, but also the actual embodiment of the pushers can be completely different than that above-mentioned one.

According to another aspect of the invention, on the surface 23 of the pushing head 22 facing the crushing group 3, there are shaped projections 24 that cooperate with the same grinding group 3 for crushing the rubble.

The shaped projections 24 may be substantially shaped as teeth that, during the push by the pusher 20 towards the crushing group 3, exert a rupture action on the rubble, thereby increasing the active participation of the pushers 20 to the crushing process.

More in detail, the shaped projections 24 have a shape that counter-shaped with respect to the shape of the correspondent portion of the crushing group 3 against which they act so as to interpenetrate with the same crushing group 3, accelerating the crushing action.

Even this last aspect of the invention, however, is to be considered not limitative.

Operatively, therefore, after the first load of rubble in the conveying channel 14, the pushers 20, initially placed in rest position, are actuated to push the rubble against the crushing group 3 and to cooperate with it to the crushing. When the amount of rubble to be crushed decreases, one or more pusher 20 are raised in order to allow the loading of further rubbles in their areas.

In case of rubble elements that are particularly tenacious, the pushers 20 can also be serially and alternately raised and re-lowered to increase their crushing action in cooperation with the crushing group 3.

As said, it is evident that the crusher for rubble of the invention achieves all the intended purposes.

Particularly, it allows the shredding of rubble without operator intervention, particularly in case of "floating" elements over the grinding group, or in case of particularly tenacious plate-like elements.

In addition, the invention enables shredding rates that are as high as possible, while still maintaining execution and cost levels at least equivalent, if not inferior, to the equivalent already known crushers.

The invention is susceptible to several modifications e variations, all falling within the inventive concept expressed in the claims. All the details may be replaced by other technically equivalent elements, and the materials may be different according to requirements, without departing the scope of the invention defined by the appended claims.

The invention claimed is:

1. A crusher for rubble comprising:

a crushing chamber, in which the rubble is crushed;

a crushing group inserted into said crushing chamber for crushing the rubble;

a conveying channel of the rubble, said conveying channel conveying the rubble toward said crushing group, wherein the crusher comprises a plurality of pushers each rotatably hinged to move away from the crushing group and toward the crushing group to face the crushing group, said plurality of pushers acting in said conveying channel to push the rubble against said crushing group by applying a downward force, at least one of said pushers being separately and independently controlled from the other pusher or pushers so as to move said at least one of said pushers in a rest position for a while when one or more of the other pusher or pushers are working in the conveying channel;

a plurality of actuators, each pusher comprising one pusher head and one actuator; and shaped projections on-extending from a surface of each pusher head facing towards said crushing group and having a shape counter-shaped over a corresponding portion of the crushing group to cooperate with the crushing group in crushing the rubble, wherein said shaped projections penetrate into said crushing group, so as to improve crushing action.

2. The crusher as claimed in claim 1, wherein said conveying channel comprises at least one loading hopper.

3. The crusher as claimed in claim 1, wherein said crushing group comprises one or more cutters.

4. The crusher as claimed in claim 3, wherein each of said one or more cutters comprises a rotor provided with a plurality of grinder discs arranged coaxial to a rotation axis of said rotor and spaced out by spacers.

5. The crusher as claimed in claim 4, wherein said one or more cutters comprise a first cutter and a second cutter facing one another and at least partially penetrating into one another, said grinder discs of the first cutter inserting in an interstice between a pair of the grinder discs of the second cutter.

* * * * *